US006759971B2

(12) United States Patent
Lumbis et al.

(10) Patent No.: US 6,759,971 B2
(45) Date of Patent: Jul. 6, 2004

(54) TRAINLINE CONTROLLER ELECTRONICS

(75) Inventors: Anthony W. Lumbis, Watertown, NY (US); Dale R. Stevens, Adams Center, NY (US); John N. Versic, Watertown, NY (US)

(73) Assignee: New York Air Brake Corporation, Watertown, NY (US)

( * ) Notice: Subject to any disclaimer, the term of this patent is extended or adjusted under 35 U.S.C. 154(b) by 146 days.

(21) Appl. No.: 10/221,344

(22) PCT Filed: Sep. 6, 2001

(86) PCT No.: PCT/US01/42011

§ 371 (c)(1),
(2), (4) Date: Sep. 11, 2002

(87) PCT Pub. No.: WO02/23503

PCT Pub. Date: Mar. 21, 2002

(65) Prior Publication Data

US 2003/0038711 A1 Feb. 27, 2003

Related U.S. Application Data

(60) Provisional application No. 60/232,482, filed on Sep. 13, 2000.

(51) Int. Cl.[7] ..... G08B 1/01; B61L 3/00

(52) U.S. Cl. ..... 340/933; 340/501; 340/3.1; 340/514; 246/167 R; 700/12; 702/122; 701/19

(58) Field of Search ..... 340/933, 3.1, 501, 340/514, 3.43, 664; 246/169 R; 700/12; 702/122; 701/19

(56) References Cited

U.S. PATENT DOCUMENTS

| | | | | |
|---|---|---|---|---|
| 5,630,565 | A | 5/1997 | Lumbis | 246/187 C |
| 5,647,562 | A | 7/1997 | Lumbis et al. | 246/167 R |
| 5,673,876 | A | 10/1997 | Lumbis et al. | 246/167 R |
| 5,907,193 | A | 5/1999 | Lumbis | 307/9.1 |
| 6,275,165 | B1 | 8/2001 | Bezos | 340/3.44 |

*Primary Examiner*—Donnie L. Crosland
(74) *Attorney, Agent, or Firm*—Barnes & Thornburg LLP

(57) ABSTRACT

Trainline controller including testing of signal quality on a trainline network by commanding each node to transmitter calibration signal. A signal detector is connected to the trainline at a common junction with a head end termination circuit. A stuck-on transmitter is determined by a transmission current drawn by the transceiver is on for a present amount of time.

12 Claims, 11 Drawing Sheets

T/L CONNECTOR
456
RET
457
SIGNAL DETECTOR
458
OPI
455

V230
V24
V24
411
POWER SUPPLY
PSINHIBIT
+V74
+V74
LOW V INHIBIT
412
FILTER
410
402
BTTY+
LOCO BATTERY
BTTY-

450
CONTROLER
TRANSMIT
467
465
REF
CURRENT SENSE
466
DISABLE
ROUTER
460
RESET
TR
461
462
TL
466
RESET
LVI
463

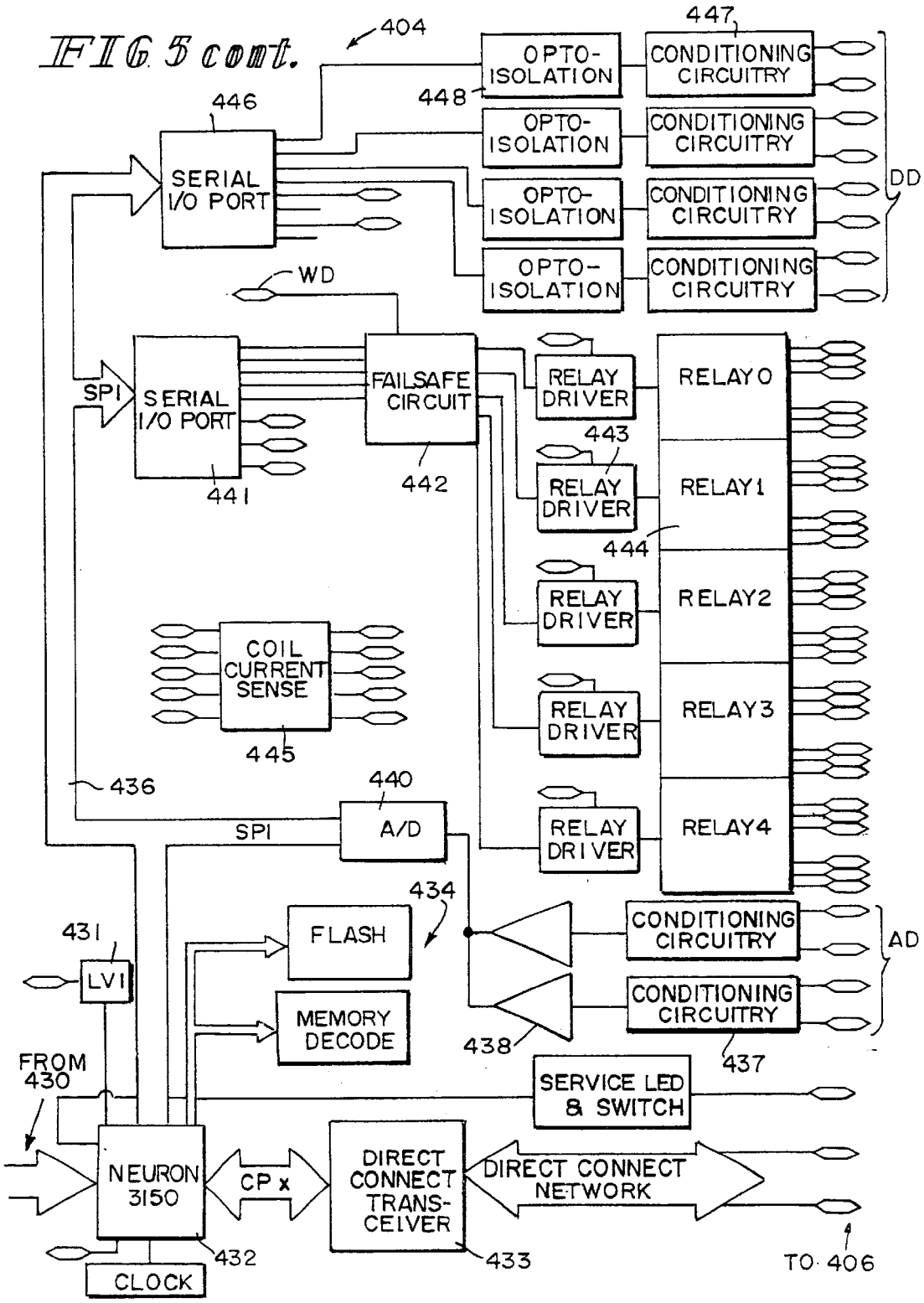
FIG 5 cont.
404
446
SERIAL I/O PORT
448
OPTO-ISOLATION
OPTO-ISOLATION
OPTO-ISOLATION
OPTO-ISOLATION
447
CONDITIONING CIRCUITRY
CONDITIONING CIRCUITRY
CONDITIONING CIRCUITRY
CONDITIONING CIRCUITRY
DD
WD
SPI
SERIAL I/O PORT
441
FAILSAFE CIRCUIT
442
RELAY DRIVER
RELAY DRIVER
RELAY DRIVER
RELAY DRIVER
RELAY DRIVER
443
444
RELAY0
RELAY1
RELAY2
RELAY3
RELAY4
COIL CURRENT SENSE
445
436
440
A/D
SPI
434
FLASH
MEMORY DECODE
431
LVI
CONDITIONING CIRCUITRY
CONDITIONING CIRCUITRY
AD
438
437
FROM 430
SERVICE LED & SWITCH
NEURON 3150
CPx
DIRECT CONNECT TRANS-CEIVER
DIRECT CONNECT NETWORK
432
433
CLOCK
TO 406

TRAINLINE CONTROLLER ELECTRONICS

This application is a 371 of PCT/US01/42011 filed Sep. 6, 2001 which claims benefit of 60/232,482 filed Sep. 13, 2000.

BACKGROUND AND SUMMARY OF THE INVENTION

The present invention relates to electropneumatic brake control on a train and more specifically to the electronic portion of the trainline controller.

Electropneumatic brake control valves are well known in the passenger railroad art and the mass transit railroad art. Because the trains are short and are not involved generally in a mix and match at an interchange of different equipment, the ability to provide pneumatic and electrical control throughout the train has been readily available in the passenger and the mass transit systems. In freight trains, the trains may involve as much as 100 cars stretching over one mile or more. The individual cars may lay idle in harsh environments for up to a year without use. Also, because of the long distance they travel, the cars are continuously moved from one consist to another as it travels to its destination. Thus, the use of electropneumatic-pneumatic valves in the freight trains has been very limited.

A prior art system with electropneumatic train brake controls is illustrated in FIG. 1. An operator control stand 10 generally has a pair of handles to control the train braking. It controls a brake pipe controller 12 which controls the brake pipe 14 running throughout the train. It also includes a trainline controller 16 with power source 17 which controls the trainline 18 which is a power line as well as an electrical communication line. The control stand 10, the brake pipe controller 12 and the trainline controller 16 are located in the locomotive.

Each car includes a car control device 20 having a car ID module 22 and a sensor 24 connected to the trainline 18. The pneumatic portion of the car brakes include a brake cylinder 26, a reservoir 28 and a vent valve 29. The car control device 20 is also connected to the brake pipe 14 and the trainline 18. The brake pipe controller 12 is available from New York Air Brake Corporation as CCBII® and described in U.S. Pat. No. 6,098,006 to Sherwood et al. The trainline controller 16 and the CCD 20 are also available from New York Air Brake as a product known as EP60®. The car control device 20 is described in U.S. Pat. No. 5,967,620 to Truglio et al and U.S. Pat. No. 6,049,296 to Lumbis et al. Each of these patents and products are incorporated herein as necessary for the understanding of the present patent.

The trainline controller 16 is shown in detail in FIG. 2. The control stand 10 includes EP brake controller 30 and an operator interface unit or display 31 which are connected to a trainline communication controller 40. The trainline communication controller 40 is connected to the trainline 18 and receives 75 volts DC from the locomotive battery. It is also connected to the locomotive systems 32. The locomotive control 16 also includes a trainline power controller 50 connected to the trainline 18. It is also connected to 75 volts DC from the locomotive as well as the trainline power supply 38. The trainline power supply 38 provides all of the voltage necessary for operation of the electronics of the trainline power controller as well as the trainline 18. The 230 volts are applied to the trainline 18 in the normal operational mode. The 24 volts are the volts that is applied to the trainline 18 during synchronization.

The example illustrated in FIG. 2 is for a lead locomotive and a trailing locomotive. The trainlines between the locomotives are connected by EP trainline connectors 34. The leading EP line connector 34 has a head end termination HETT 36 terminating the trainline. The trainline communications controller 40 controls the trainline and communication and the power through the trainline power controller 50. Although the trainline power controller 50 and the trainline power supply 30 are shown in a second locomotive, they may also be located in the leading locomotive. Also, it is anticipated that all of the locomotives will have a trainline communication controller and a trainline power line controller therein. Using multiple power sources to power the trainline is described in U.S. Pat. No. 5,907,193 to Lumbis. Testing the trainline before powering up is also described in U.S. Pat. No. 5,673,876 to Lumbis et al.

The present invention is improvements in the trainline controller electronics. It includes a method for testing a signal quality for each node in the wire network on the train. This method includes commanding each node to be in a receiving node followed by commanding each node, one at a time, to transmit a calibration signal. Then, a determination is made of the quality of the calibration signals as function of the length of the transmission path on the wire. A system to perform this method includes a transceiver and a level sensor circuit connected to the trainline. A controller connected to the transceiver and level sensor controls the sending of the commands by the transceiver to each node and receives signals from the level sensor circuit. The transceiver and level sensor circuits are connected to the trainline by a common transformer. The level sensor circuit includes a filter and signal conditioning circuits. The filter may have a variable gain set by the controller. The signal conditioning circuit may include a rectifier and peak detector. It may also includes an analog to digital converter connecting the peak detector to the controller. The level sensor circuit may include a sensor control to store the signals from the signal conditioning circuit and send it to the controller. The sensor control may signal the controller that a conditioned calibration signal is ready and the controller requests transmission of the condition calibration signal. The sensor control may detect the presence of the calibration signal and activates the signal conditioning circuit.

The trainline communication controller on a locomotive and a wired network with the nodes in the car may include a transceiver and a signal detector connected to the trainline. A head end termination circuit is connected to the trainline at a common node with the signal detector. The controller is connected to the transceiver and the signal detector. This signal detector may include a transceiver connected to the trainline which detects the presence of a transmission packet. A multiplexer may be included which connects the signal detector to a front end and a rear end termination circuits. The detector may be connected to the junction by inductors and a rectifying bridge.

A method is provided for identifying stuck-on transmitting of a transceiver in a train network where the transceiver draws a first current for transmitting and a second car for receiving. The method includes sensing the current drawn by the transceiver and determine if the sensor current is between the first and second currents. Finally, a stuck-on detector is identified if the sensed current is determined to be between the first and second currents for more than a preset amount of time. The current can be sensed using a current mirror and the determining is performed by a comparator connected to the current. The identifying can be performed by a microprocessor which measures the time and identifies the stuck-on transmitter. The microprocessor may also disable a transmitter when identified is stucked on.

A transceiver control circuit may also be provided to perform the method and would include a current sensor, a comparator, and a timer. A controller identifies a stuck-on transmitter when the amount of time, the sensor current is determined to be between the first and second currents, is more than a preset amount of time. The current sensor includes a current mirror contact connected to the receiver and comparator. Also, the timer and the controller may be in a microprocessor. The controller disables a transmitter when identified as stuck-on. This is performed by providing a disable signal at the reset terminal of the transceiver. A reset circuit is connected to the reset terminal of the transceiver and the controller.

Other objects, aspects and novel features of the present invention will become apparent from the following detailed description of the invention when considered in conjunction with the accompanying drawings.

DETAILED DESCRIPTION OF THE PREFERRED EMBODIMENTS

Figure 3:
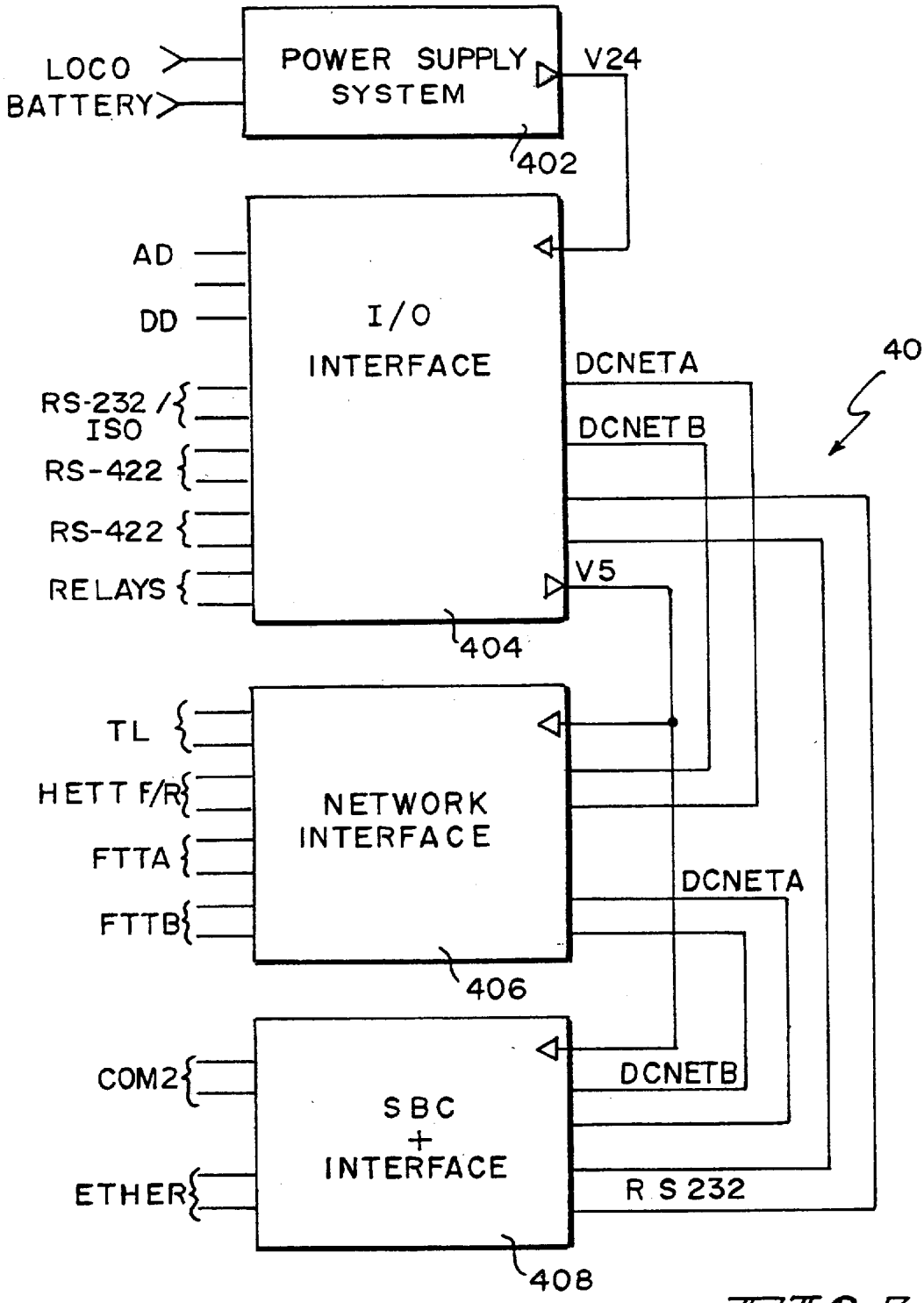
FIG. 3 is a block diagram of the trainline communications controller of the trainline controller of the present invention.

As shown in FIG. 3, the trainline communication controller 40 includes a power supply system 402, an I/O interface 40, a network interface 406 and a single board computer and interface 408. The power supply system 402 is connected to the battery and receives voltage from it and provides the necessary voltage for the circuit in the trainline controller 40. Output voltage V24 is provided to the I/O interface 404. The I/O interface is connected to the network interface 406 by DC NETA and DC NETB. These are Lonwork networks. I/O interface 404 is also connected to the SBC interface by a RS232 line. The network interface 406 is connected to the SBC and interface by Lon net DC NETA and DC NETB. I/O interface 404 converts the V24 into V5 and provides it to the network interface 406 and the SBC and interface 408.

The I/O interface 404 provides the interface between the Lonworks direct connect network DC NETA and the locomotive. The I/O interface 404 is connected outside the trainline communication controller 40 by analog inputs AD, digital inputs DD, RS 232 communication isolated port, two RS422 isolated ports and relay outputs. The RS422 ports may be connected to distributive power systems or an event recorder. The RS 232 port may be connected to a portable test unit.

The network interface 406 provides an interface between an internal direct contact network and the external Lon network. The network interface 406 is connected to the trainline terminals TL, head end termination HETT of the forward and rear terminations and Lon networks FTTA and FTTB. The head end termination terminals HETT are connected to head end termination 36 at the forward end as well as one at the rear end of the locomotive.

SBC and interface 408 includes a high performance single board computer SBC integrated with a custom design network adaptor. This assembly provides the direct communication between the SBC and the internal Lon network DC NETA and B. The connections outside the trainline communication controller for the single board computer are comm 2 ports and ethernet ports. Most of the output connections are to the locomotive systems 32.

It should be noted that Lonworks is the network choice of the industry, although other networks may be used. The basic nodes include neuron chips which communicate with each other as well as local transceivers and power line transceivers.

Figures 4, 7, 8:
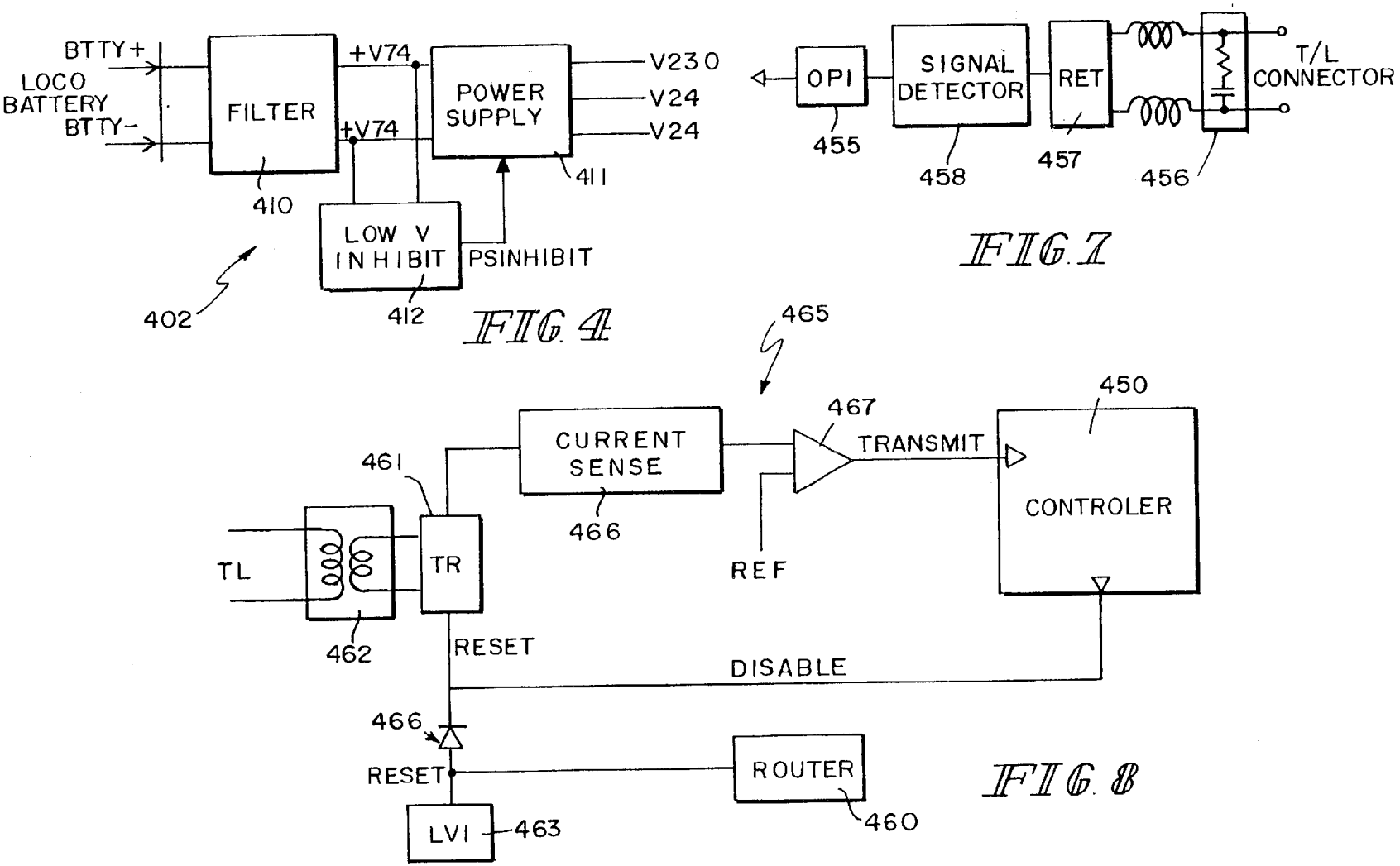
FIG. 4 is a block diagram of the power supply system of the trainline communications controller according to the principles of the present invention.
FIG. 7 is a block diagram of the trainline communication signal detector circuit according to the principles of the present invention.
FIG. 8 is a block diagram of the suck-on transceiver circuit according to the principles of the present invention. invention.

The power supply system 402, as illustrated in FIG. 4, connects the locomotive battery at terminals BTTY+ and BTTY− through filter 410 to a power supply 411. The power supply may be, for example, an Melcher supply. It provides outputs V24 and V230. Also connected to the output of the filter 410 is a low voltage inhibits circuit 412. This monitors the voltage at the output of the filter which represents voltage of the battery. If the battery voltage is below a desired point, it produces a power supply inhibit signal to disable the power supply 411. This will shut down the trainline communication controller 40.

Figure 5:
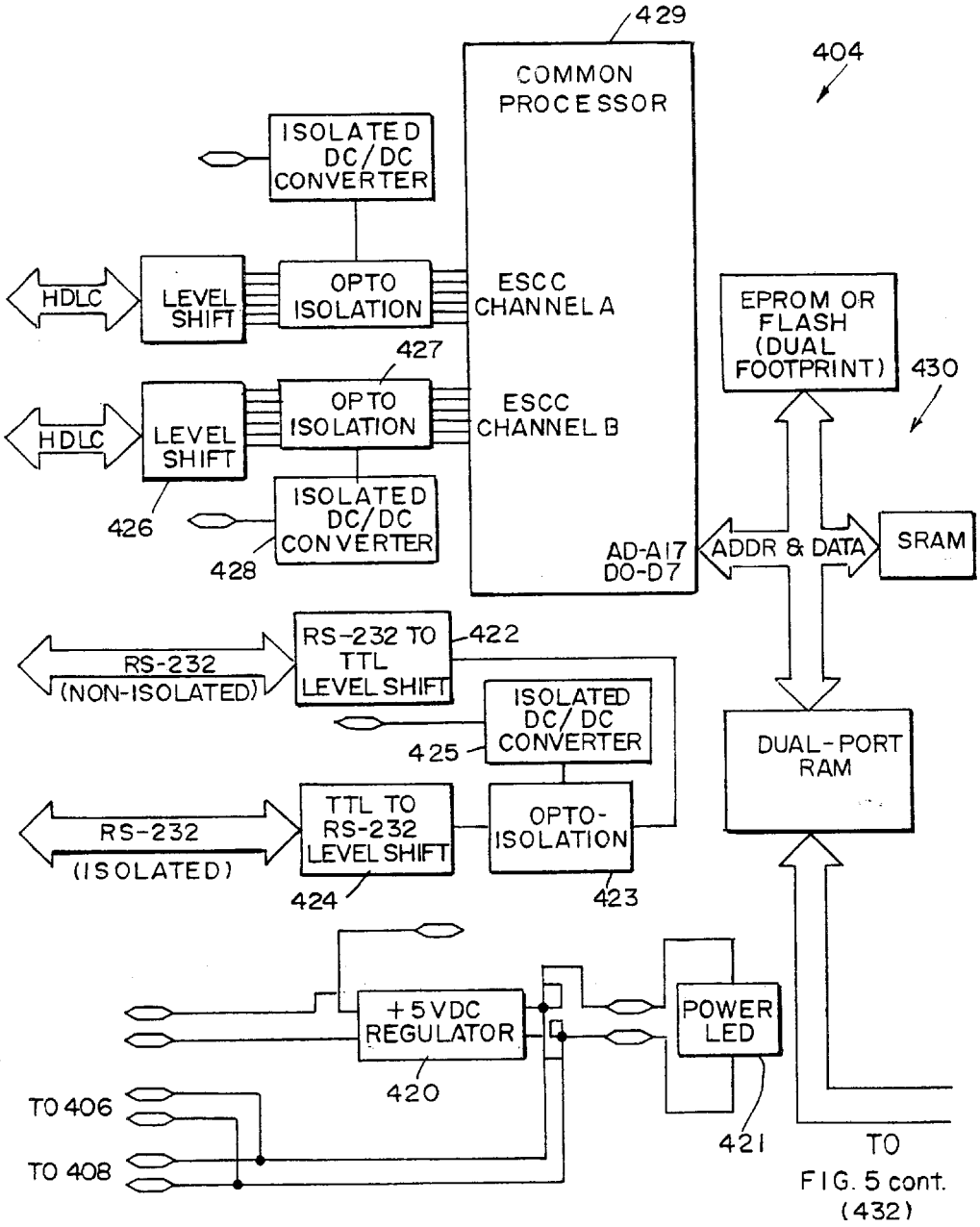
FIG. 5 is a block diagram of the I/O interface of the trainline communications controller according to the principles of the present invention.

The I/O interface 404 is shown in detail in FIG. 5. A voltage regulator 420 receives the V24 from the power supply system 402 and provides voltages V5 to the network interface 406 and the SBC and interface 408. It also lights a diode 421 indicating that it is receiving power from the power supply system 402. The RS 232 communication port from the SBC interface 408 goes through the level shifter 422, optical isolator 423 and level shifter 424 to provide an isolated RS 232 port. An isolated DC to DC converter 425 powers the opto-isolator 423. The HDLC or RS 422 port also goes through level shifter 426 opto-isolator 427, having an isolator DC to DC converter 428 to a communication processor 429. The communication processor 429 provides data to and from the memory system 430.

The controller of the I/O 432 is a neuron chip connected by a direct connect transceiver 433 to a direct connect network having an output DC NETA and DC NETB to the network interface 406. The controller 432 includes additional memory 434. The controller 432 is also connected to a SPI bus 436.

The analog inputs AD are connected through signal conditioning circuits 437 and buffer 438 to an A-D converter 440 to the SPI bus 436. The serial I/O port 441 connects SPI 436 to failsafe circuit 432 which is connected to relay drivers 433. The relay drive 443 drives the relay 444. The failsafe circuit 432 receives a failsafe signal from the controller 432. Upon absence of the signal from 432, the failsafe circuit 442 automatically resets the relay drivers 443 to deactivate the relays 444. Coil current sensor 445 determines that the relays have been activated and provides a signal back to the controller 432 through serial I/O port 441 and 446. The serial I/O port 446 also connects the SPI 436 through opto-isolator 438 to conditioning circuits 447 for the digital input ports DD.

A powerup reset LVI 431 is connected to the controller 432 and the failsafe circuit and resets them on power up.

Figure 1:
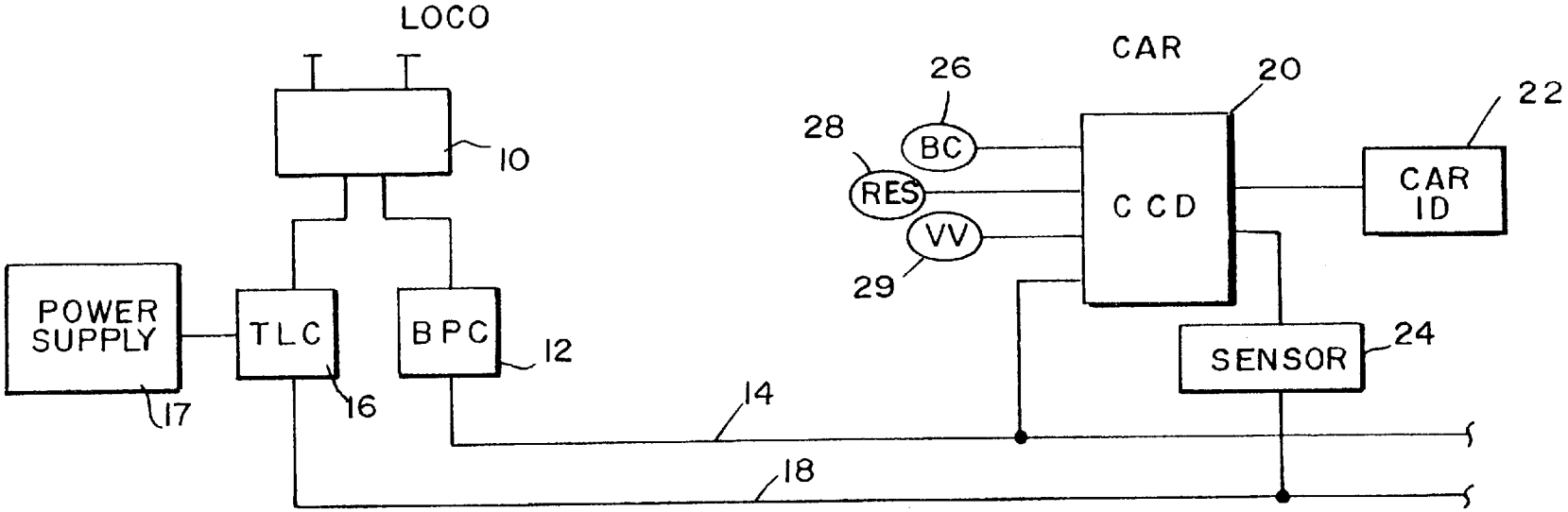
PRIOR ART FIG. 1
FIG. 1 is an electropneumatic brake control system of the prior art.
Figure 2:
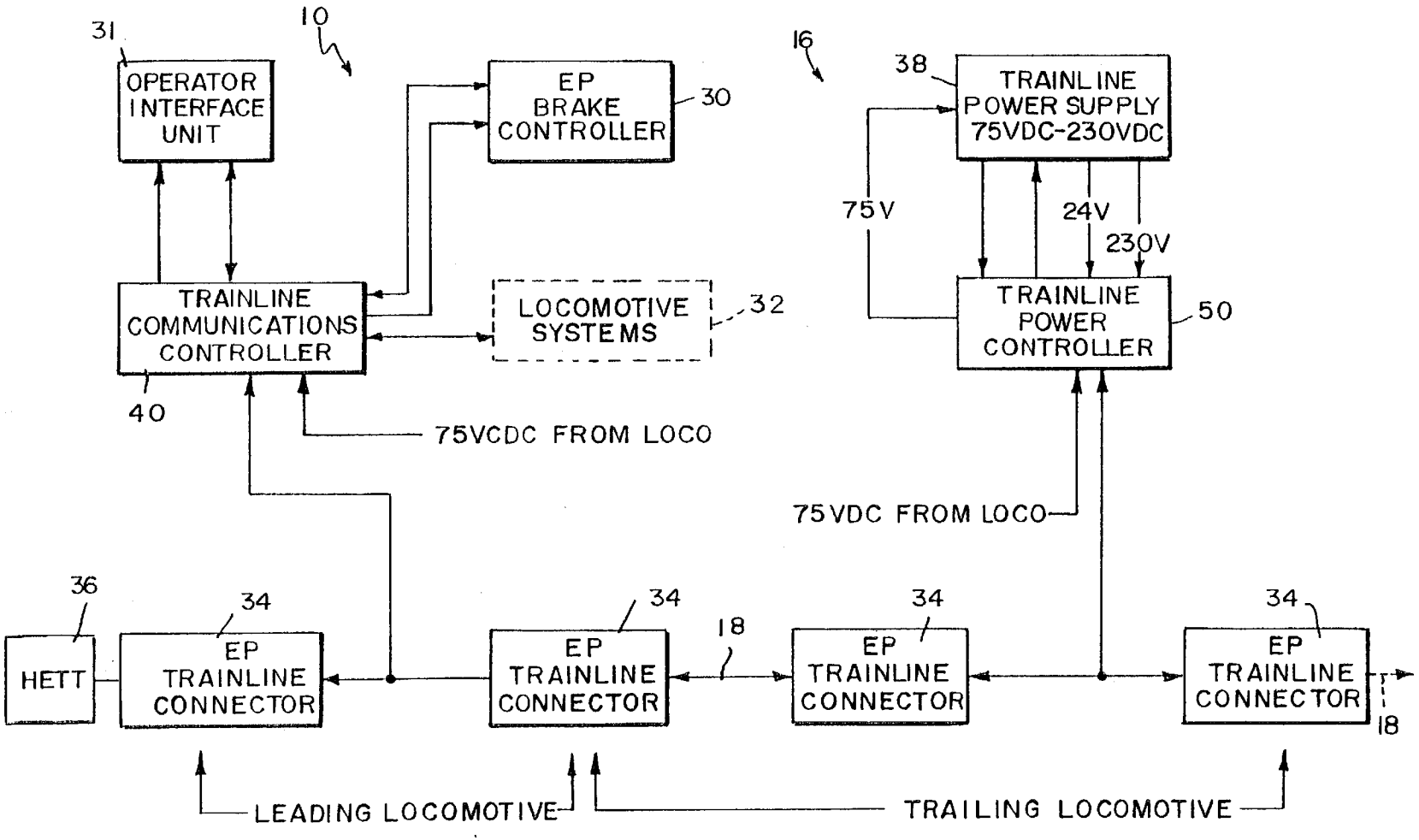
PRIOR ART FIG. 2
FIG. 2 is a block diagram of the trainline controller of the prior art.
Figure 6:
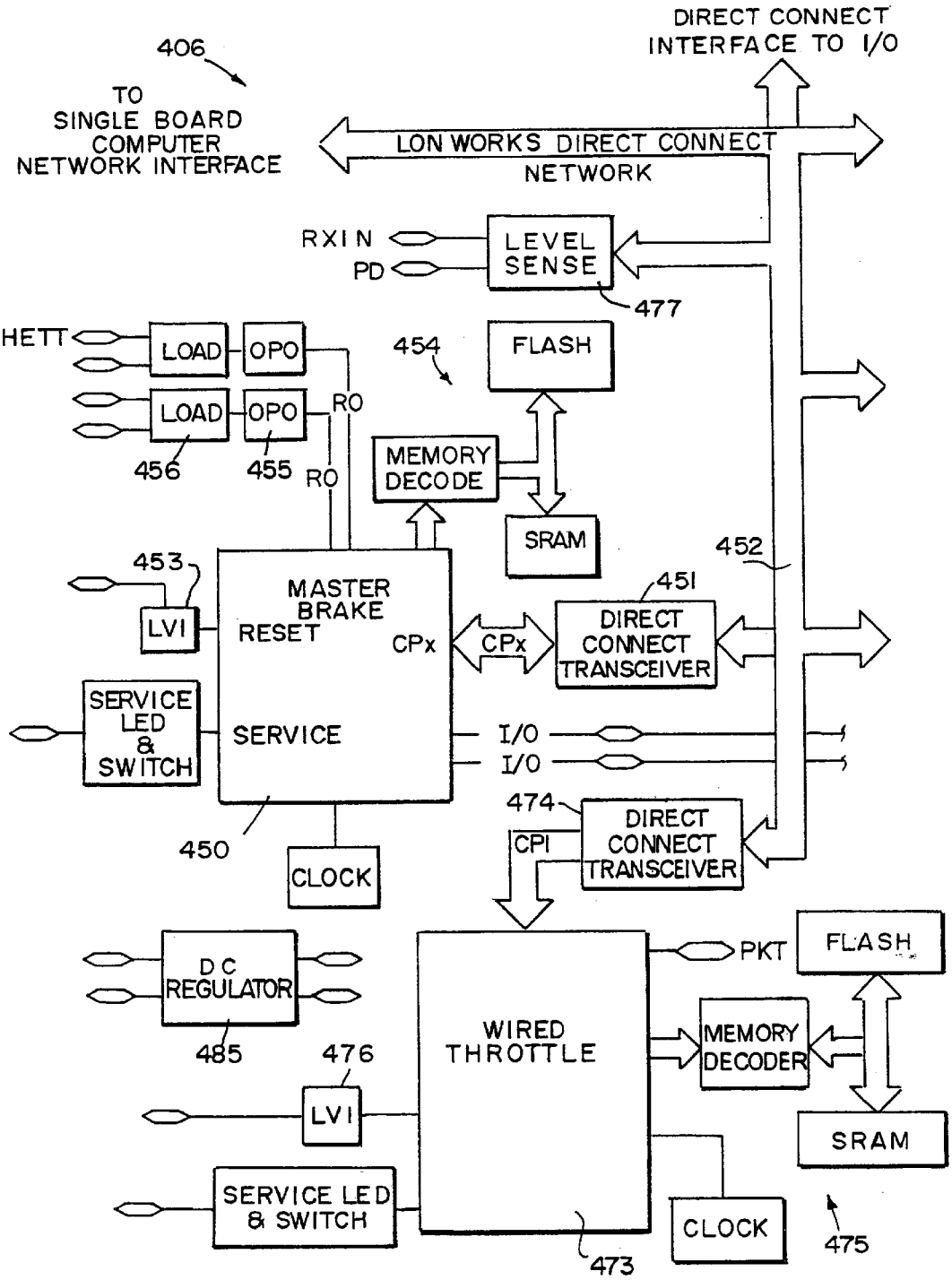
FIG. 6 is a block diagram of the network interface of the trainline communications controller according to the principles of the present
Figure 6:
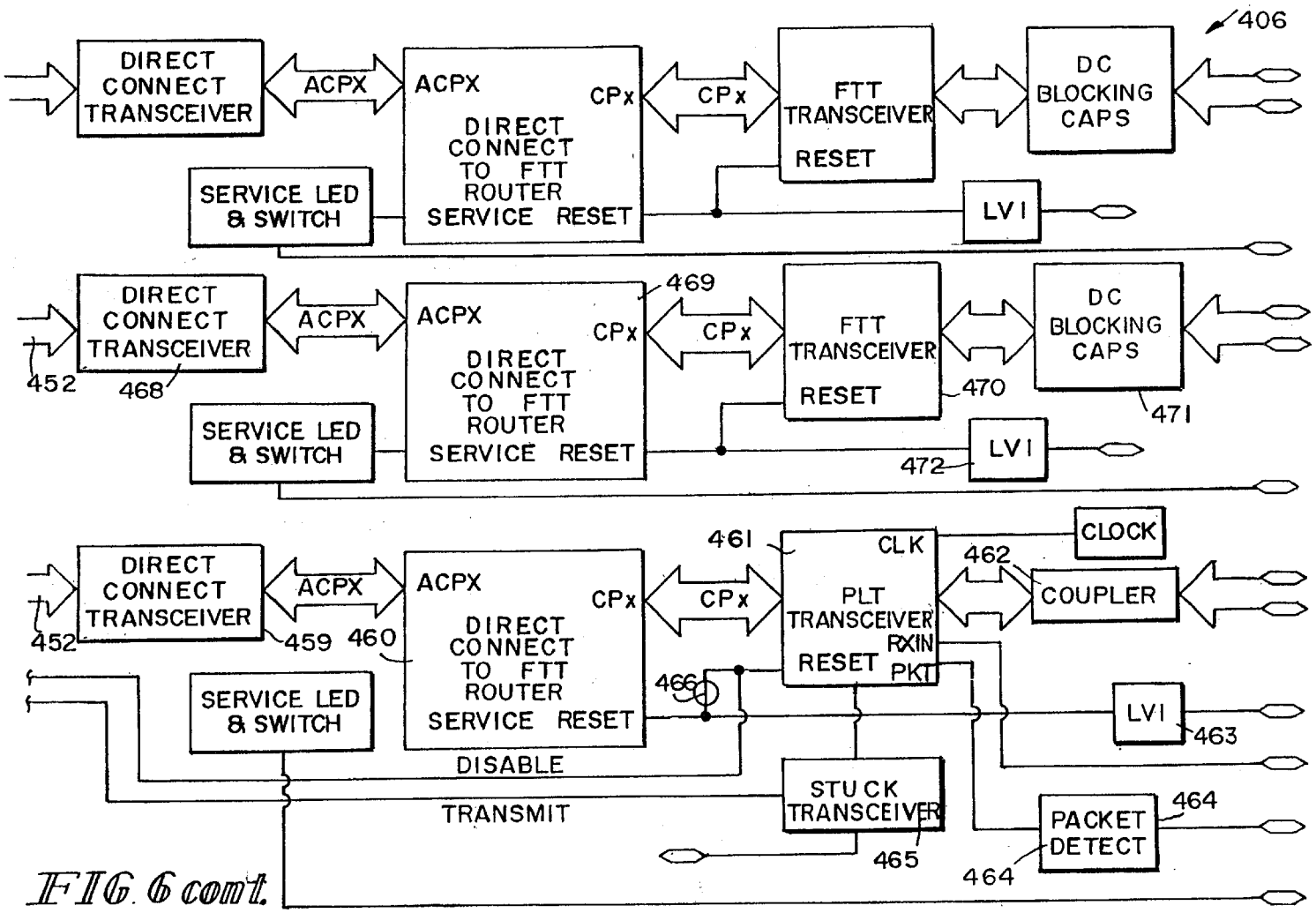

The network interface 406 is illustrated in FIG. 6 and includes a master brake controller 450 connected by direct connect transceiver 451 to a direct connect network 452. A power up restart 453 and memory 454 are also connected to the master brake controller 450. Head end termination HETT is connected to the master brake controller 450 by optical isolators 455 and load 456. As illustrated in more detail in FIG. 7, the load 456 is a resistor-capacitor combination which is connected across the trainline at the trainline connector 34 of FIG. 2. A rectifier 457 and signal detector 458 are also connected and through inductors to the trainline in parallel to the load 456.

Figure 11:
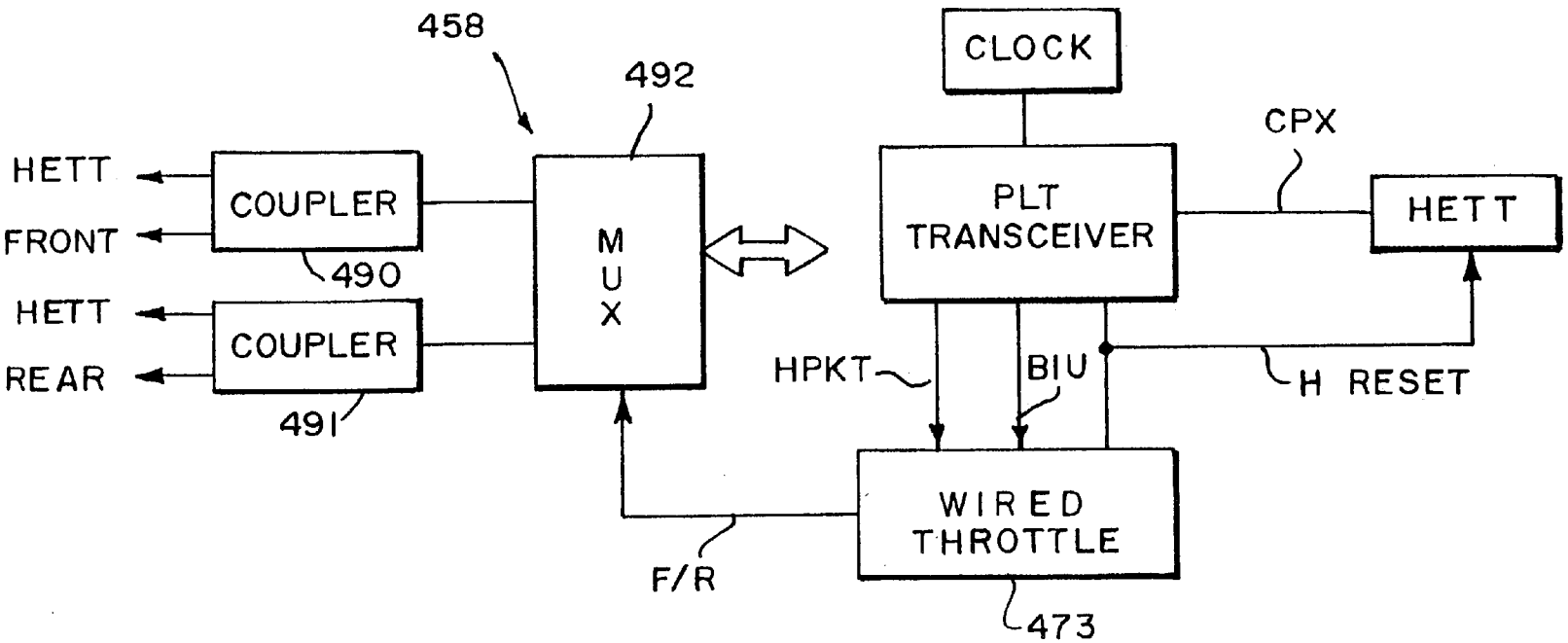
FIG. 11 is a block diagram of another embodiment of the trainline communication signal detector circuit according to the principles of the present invention.

An alternative embodiment of the signal detector 458 and its connection to the remainder of system is shown in FIG. 11. The front and rear end terminations HETT are connected by couplers 490 and 491 respectively to a multiplexer 492. The multiplexer 492 connects one of the HETT's to the transceiver 493 under the control F/R of the wired throttle controller 473. The transceiver 493 determines and provides packet detect signals PKT and band in use BIU to the controller 473, which determines the presence of communication in the front HETT, rear HETT or both. The HETT controller may be a Neuron having only the transceiver portion programmed.

The HETT circuitry works in conjunction with the trainline termination connector on each end of the locomotive and provides a means for detecting the communication signal on the trainline while at the same time terminating the trainline. Detection of the communication signal provides indication that the otherwise live trainline connector in the locomotive is connected and it is safe to energize the trainline. This is in addition to or in lieu of the automatic electric train safety interlock described in U.S. Pat. No. 5,673,876 to Lumbis et al.

As illustrated in FIG. 6, the direct connect network 452 is connected through direct connect transceiver 459 and router 456 to a transceiver 461. The transceiver 461 is connected by coupler 462 to the trainline. The transceiver 461 sends and receives signals to control the trainline power supply and the power supply and braking of individual cars. It also controls serialization and initialization. The transceiver 461 may be a PLT-10 from Lonworks. The powerup reset 463 is connected to the reset of the router 460 and through a switch or diode 466 to the reset of transceiver 461. Packet detect circuit 464 is also connected to the packet input of transceiver 461.

A stuck transmitter circuit 465 is connected to the transceiver 461 and upon detecting that it is in the transmission mode, provides a transmit signal to the master brake controller 450. If the transceiver 461 is in the transmission mode for too long a period, a DISABLE signal is issued by the master brake 450 to the reset input of the transceiver 461. The diode 466 prevents the DISABLE signal from resetting the router 460. The time period may be, for example, ½ a second.

As illustrated in more detail in FIG. 8, a stuck transmitter circuit 465 has a current sensor 466 and a comparator 467 to compare the output of the current sensor to a reference value. The transceiver draws a greater current in the transmission than it does in the receiving mode. The reference value is selected between the transmission and receiving values. Coupler 462 is shown as a transformer.

As shown in FIG. 6, the direct connect network 452 is connected through direct connect transceiver 468 and router 469 to a transceiver 470. The transceiver 470 is connected through coupler 471 to the network FTTA or FTTB. The transceiver may be an FTT 10 from Lonworks. Two of these transceiver networks are shown. A power up reset 472 is connected to the transceiver 470 and the router 469.

A second controller 473 is connected via the direct connect transceiver 474 to the direct connect network 452. It includes the memory 475 and a power up reset 476. The second controller 473 performs a calibration of the transceivers on the trainline and in each of the cars using a level sense circuit 477. The second controller 473 provides an indication of the relative signal strength of the communication signals from any node on the network.

The controller 473 broadcasts a message to all nodes to turn off their transceiver. This would be through transceiver 461. Then, the second controller 473 would command each of the nodes, one at a time, to transmit a calibration signal. The received calibration signal would be sensed by the level sense circuit 477 by the RXIN and packet detect circuit off the coupler 462 of transceiver 461. The value of the signal is then transmitted by 477 to the controller 473. This information can be used to determine the relative indication of the integrity of the trainline connectors with respect to the communication signal. Also, the termination of the quality signal is made with respect to the location of each node of the train. This takes into account the signal loss due to the communication path between the commanded node and the transceiver 461.

Figure 9:
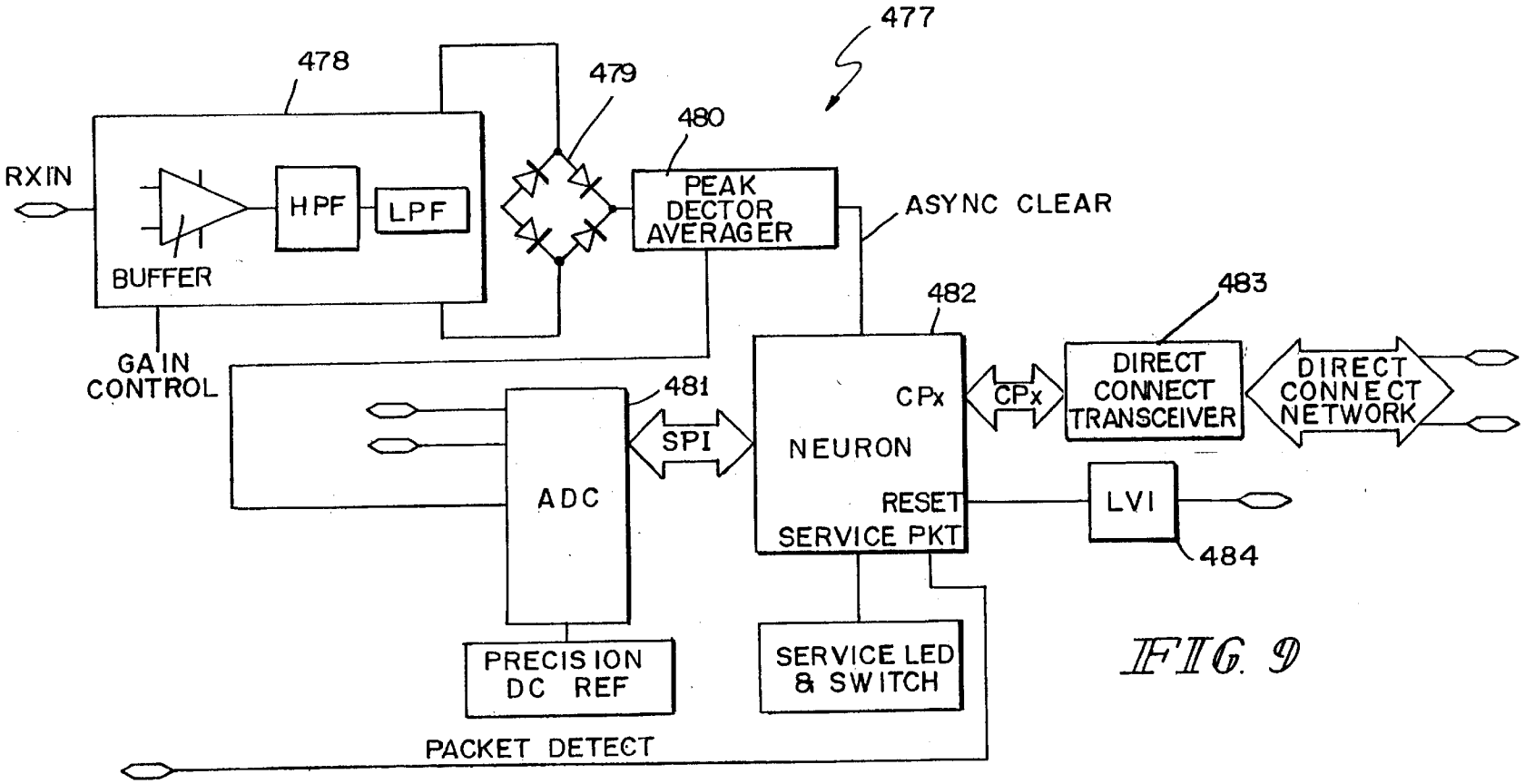
FIG. 9 is a block diagram of the calibration level sensing circuit according to the principles of the present invention.

The detail of the level sensor circuit 477 is illustrated in FIG. 9. The received calibration signal at RXIN is filtered and signal conditioned. The first stage 478 includes a high pass filter with a gain which is adjustably controlled by the second controller 473. It is followed by a third order low pass filter. A precision rectifier 479 then rectifies and filters the signal and provides it to a peak detector averager 480. The output of the peak detector 480 is provided to an analog to digital converter 481. Once the signal has been processed and converted and stored in neuron 482, it transmits a signal ready to the second controller 473. The second controller 473 then requests that the processed signal be transmitted. The pack detect in combination with the asynchronous clear signal triggers the ADC 481 to acquire the data from RXIN. A powerup reset 484 is connected to the neuron 482.

Figure 10:
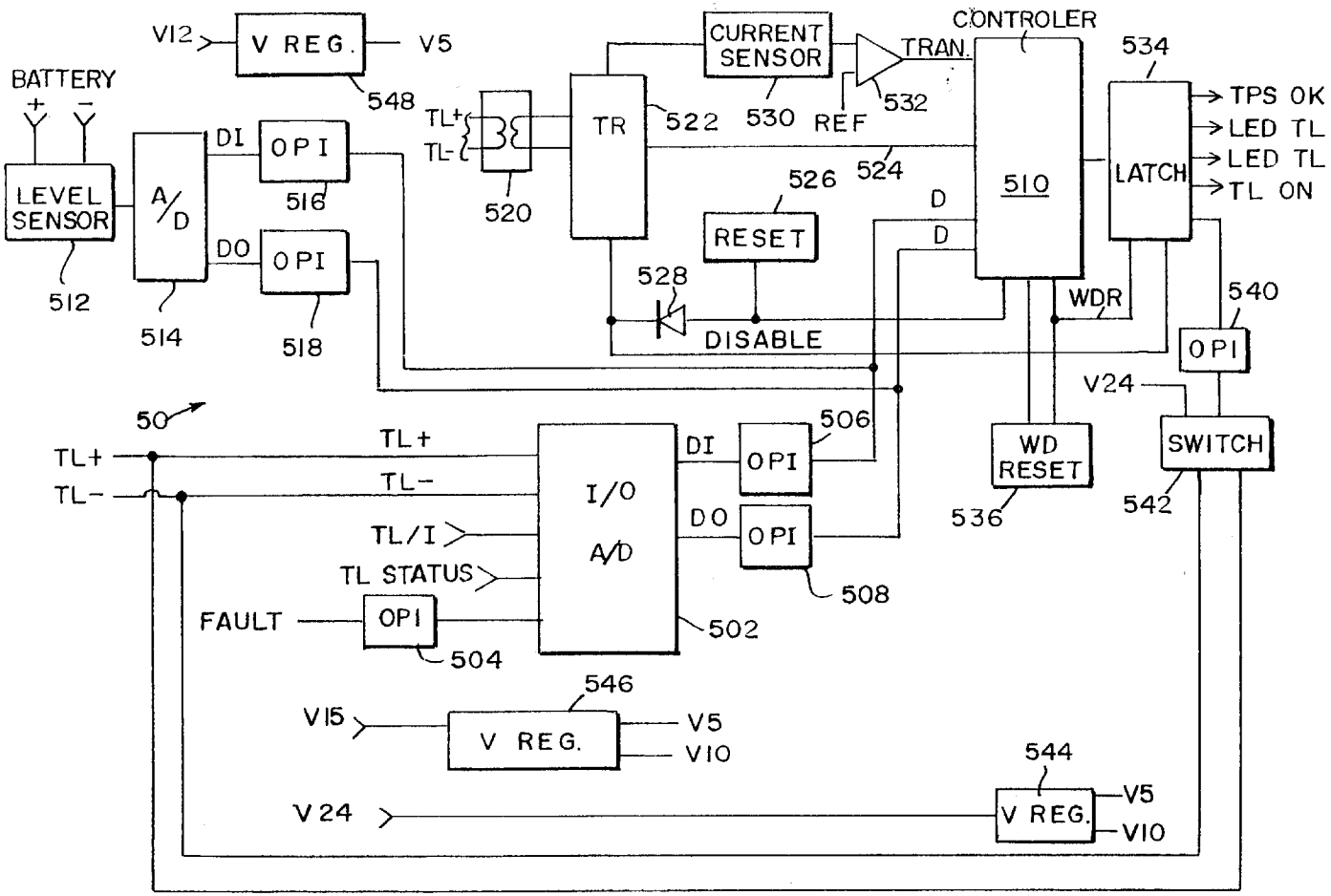
FIG. 10 is a block diagram of the trainline power controller according to the principles of the present invention.

The trainline power controller 50 is shown in detail in FIG. 10. An I/O analog to digital converter 502 connects the trainline TL, trainline current TL/I, trainline status TL STATUS and a trainline fault signal FAULT through opto-isolators 504 to a controller 510, which is a neuron, through opto-isolators 506 and 508. The locomotive battery and terminals BTTY+, BTTY− are connected through level detector 512, AD converter 514 and opto-isolators 516 and 518 to the controller 510. Thus, controller 510 has all of the information on the trainline power supply 38 and the locomotive battery.

The trainline TL is connected through transformer 520 to a transceiver 522 which is connected by bus 524 to the controller 520. The power up reset 526 is connected to the controller 510 and through diode 528 to the reset of transceiver 522. A current sensor 530 is connected to the transceiver 522. The sensed current of the transceiver 522 is compared at comparator 532 to a preset reference to determine whether the transceiver 522 is in the transmitting mode. If it is in the transmitting mode, the signal TRANSMIT is provided to the controller 510. If it is in the transmit mode too long, for example ½ a second, then the controller 510 through latch 534 provides a DISABLE signal to the reset terminal of transceiver 522. The diode 528 prevents this DISABLE signal from resetting the controller 510.

A watchdog reset 536 receives a strobe signal from the controller 510. If the strobe signal is not received in the timeout period of the reset 536, a watchdog reset is provided to the controller 510 and the latch 534. The latch latches outputs from 510 which include trainline power supply TPSOK, trainline light emitting diodes LEDTL and trainline on signal TLON. The TLON signal is used by the trainline power supply 38 to apply the 230 volts to the trainline. It also provides, through optical isolator 540, a control signal switch 542 which provides the voltage V24 to the trainline TL+ and TL−.

V24 received from the trainline power supply 28 is provided to voltage regulator 544 which provides internal voltages V5 and V10. A second voltage regulator at the controller portion 510. Regulator 546 receives the voltage signal V15 from the trainline power source 538 and provides reference voltage V5 to the I/O A to D converter 502. Voltage regulator 548 receives voltage signal V12 from the trainline power supply 38 and provides the referenced voltage V5 to the level sensor 512 and the A to D converter 514.

Although the stuck-on transmission mode has been described with respect to the trainline communication controller 40 and the trainline power controller 50, the same circuitry can be provided in the car control device 20.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A method of identifying stuck-on transmitting of a transceiver in a train network where the transceiver draws a first current for transmitting and a second current for receiving, the method comprising:

sensing the current drawn by the transceiver;

determining if the sensed current is between the first and second currents; and identifying a stuck-on transmitter if the sensed current is determined to be between the first and second currents for more than a preset amount of time.

2. The method according to claim 1, wherein the current is sensed using a current mirror and the determining is performed by a comparator connected to the current mirror.

3. The method according to claim 2, wherein the identifying is performed by a microprocessor which measures the time and identifies a stuck-on transmitter.

4. The method according to claim 3, wherein the microprocessor disables the transmitter when identified a stuck-on.

5. The method according to claim 1, including disabling the transmitter when identified as stuck-on.

6. A transceiver control circuit for a transceiver in a train network wherein the transceiver draws a first current for transmitting and a second current for receiving, the circuit comprising:

a current sensor sensing the current drawn by the transceiver;

a comparator determining if the sensed current is between the first and second currents;

a timer determining the amount of time the sensed current is between the first and second currents; and a controller identifying a stuck-on transmitter when the amount of time, the sensed current is determined to be between the first and second currents, is more than a preset amount of time.

7. The circuit according to claim 6, wherein the current senor includes a current mirror connected to the transceiver and the comparator.

8. The circuit according to claim 6, wherein the timer and the controller are in a microprocessor.

9. The circuit according to claim 6, wherein the controller disables the transmitter when identified as stuck-on.

10. The circuit according to claim 9, the controller maintains a disable signal at a reset terminal of the transceiver to disable the transmitter.

11. The circuit according to claim 10, including a reset circuit connected to reset terminals of the transceiver and the controller and a diode connected between the reset terminals of the transceiver and the controller to isolate the disable signal from the transceiver reset terminal.

12. The circuit according to claim 10, including a reset circuit connected to reset terminals of the transceiver and the controller and the controller subsequently removes the disable signal from the transceiver reset terminal and the reset circuit provides a reset signal to the reset terminals of the transceiver and the controller.

* * * * *